United States Patent [19]

DiCola

[11] 4,104,562

[45] Aug. 1, 1978

[54] TRAFFIC LIGHT DIMMER SYSTEM

[75] Inventor: Joseph A. DiCola, Willingboro, N.J.

[73] Assignee: Traffic Systems, Inc., Brentwood, N.Y.

[21] Appl. No.: 742,582

[22] Filed: Nov. 17, 1976

[51] Int. Cl.[2] ..... H05B 41/392; H05B 39/04

[52] U.S. Cl. ..... 315/158; 315/310; 315/199; 340/46

[58] Field of Search ..... 315/158, 156, 154, 308, 315/310, 307, 149, 159, 311, 199, 86, 306, DIG. 4; 340/46

[56] References Cited

U.S. PATENT DOCUMENTS

| | | | |
|---|---|---|---|
| 3,500,455 | 3/1970 | Ross et al. | 315/149 |
| 3,500,456 | 3/1970 | Ross et al. | 315/149 |
| 3,863,104 | 1/1975 | Bolhuis | 315/154 |
| 3,885,197 | 5/1975 | Moses | 315/194 |

*Primary Examiner*—Alfred E. Smith
*Assistant Examiner*—Charles F. Roberts
*Attorney, Agent, or Firm*—Duffield and Lehrer

[57] ABSTRACT

Power consumption by traffic lights is reduced during the nighttime hours by allowing only part of each cycle of the alternating current to the lights to pass through. A photo conductive cell which is responsive to ambient light intensities controls a timing device which in turn controls the device for allowing current to flow to the lights. Detection devices monitor the proper operation of the devices which allow current to flow through the lights. In the event that an improper operation is detected, an override relay switches full power to the lights.

10 Claims, 2 Drawing Figures

TRAFFIC LIGHT DIMMER SYSTEM

BACKGROUND OF THE INVENTION

The present invention is directed toward a traffic light dimmer system and more particularly toward a system which reduces the power to traffic lights as the ambient light intensity decreases, i.e. during the nighttime hours. The system also includes a means for monitoring itself and bypassing the reduction circuit thereby providing full power to the lights in the event of a failure in the reduction circuit components.

It is well known in the art that the intensity of traffic lights may be substantially reduced during periods of darkness without sacrificing the proper visability of the traffic lights for safety purposes. It is also known that significant amounts of energy can be saved by reducing the amount of power to traffic lights during periods of darkness. Circuits for reducing power to traffic lights are shown, for example, in U.S. Pat. Nos. 3,500,455; 3,500,456; and 3,885,197.

While the circuits described in the foregoing patents may be somewhat effective, they all suffer from the same serious drawback. In the event of a failure in the components which actually reduce the power to the traffic lights, it is possible that all power to the traffic lights will be removed thereby disabling the lights. U.S. Pat. No. 3,885,197 does recognize this problem and attempts to provide some solution thereto. However, the solution is not satisfactory.

The circuit described in U.S. Pat. No. 3,885,197 includes a power switch means which is normally closed thereby allowing full power to pass to the traffic lights. When a photocell senses a reduction in the ambient light, the power switch means is caused to periodically open thereby effectively reducing the power to the traffic lights. The patent suggests that this is a fail safe means since, with the switch normally closed, 100 percent of the power will be delivered to the traffic lights in the event that the dimmer circuit is not operating properly. The patent, however, overlooks the possibility that the circuit could malfunction in such a manner to cause the power switch means to remain open. This would cause the traffic lights to turn off and remain off. The patented circuit cannot protect for this type of malfunction.

SUMMARY OF THE INVENTION

The present invention overcomes all of the above described disadvantages of the prior art and provides a traffic light dimmer system which reduces the power consumption of traffic lights during the nighttime hours by allowing only part of each cycle of the alternating current to the lights to pass through. A photoconductive cell which is responsive to ambient light intensities controls a timing device which in turn controls the device for allowing current to flow to the lights. A detection device monitors the proper operation of the device which allows current to flow through the lights and in the event that an imporper operation is detected, an override relay switches the full power to the lights.

A means is also provided which insures that at least fifty percent of the available power is delivered to the lights and a detection device is also associated with this means so that full power can be delivered to the lights by an override relay in the event of a failure of this means. Even further, in the event of a brown out, full available power is delivered to the lights.

BRIEF DESCRIPTION OF THE DRAWINGS

For the purpose of illustrating the invention, there is shown in the drawings a form which is presently preferred: it being understood, however, that this invention is not limited to the precise arrangements and instrumentalities shown.

DETAILED DESCRIPTION OF INVENTION

Figure 1:
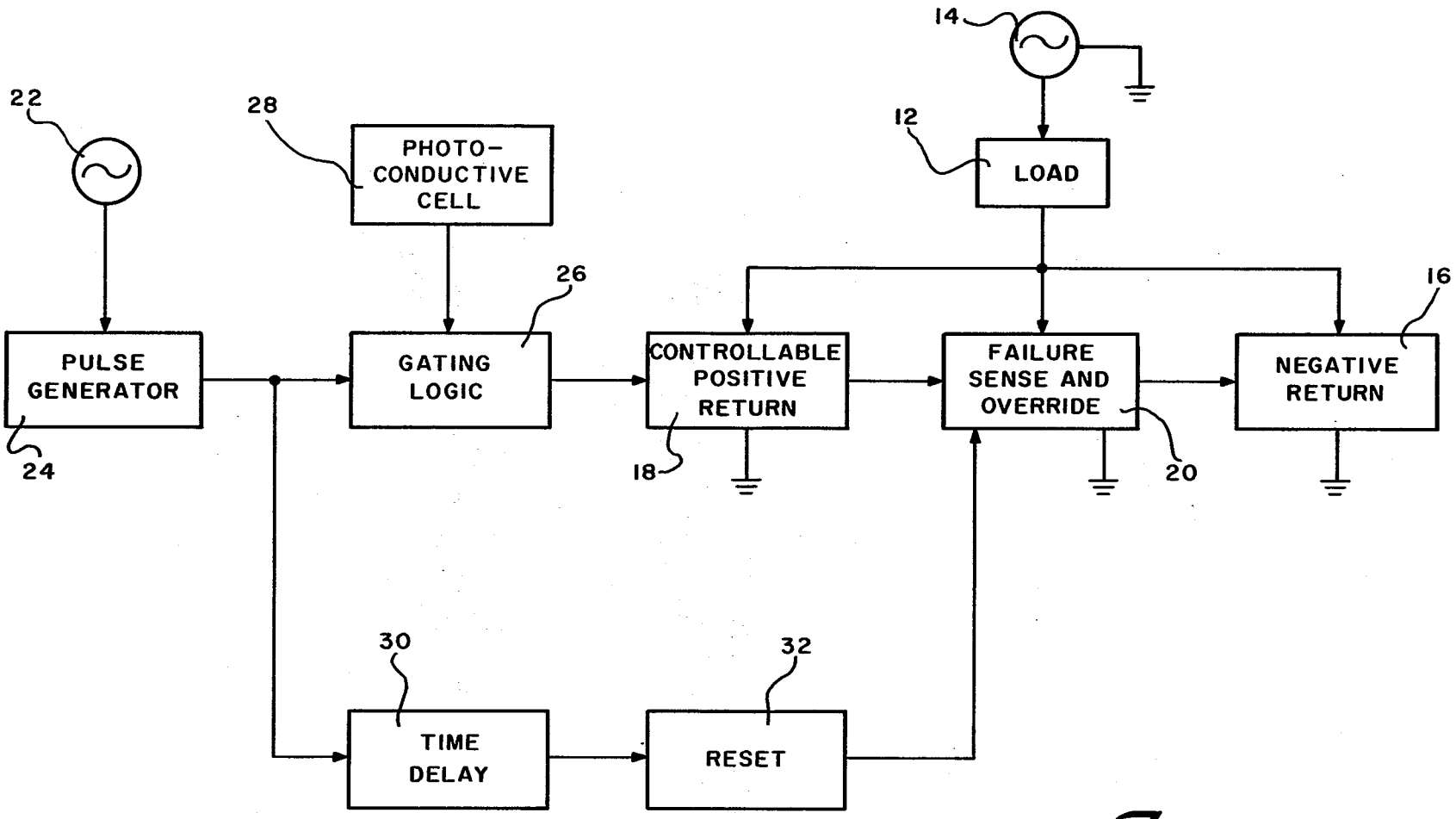
FIG. 1 is a block diagram showing a circuit constructed in accordance with the principles of the present invention.

Referring now to the drawings in detail and particularly to FIG. 1, there is shown a traffic light dimmer circuit constructed in accordance with the principles of the present invention and designated generally at 10. The block diagram of the circuit 10 is shown connected to a load 12 which may be one or more traffic lights or any other type of lighting which is desired to be controlled. The other side of the load 12 is connected to one side of an alternating current source 14 which may be a conventional 115 volt 60 cycle A.C. line.

In accordance with the principles of the invention, each half of the alternating current cycle is treated separately. Thus, the load 12 is connected to both a negative return 16 and a positive return 18. Preferably, one of the negative return 16 and positive return 18 is controllable and the other is fixed. In the preferred embodiment, the negative return 16 is fixed. Thus, during each negative half of each cycle of the source 14, current passes through the series connected source 14, load 12 and negative return 16. Since the negative return 16 is fixed, it is assured that at least 50 percent of the power is supplied to the load 12.

As stated above, positive return 18 is controllable. This means that the current passing through the series circuit comprises of source 14, load 12 and positive return 18 can be controlled by signals applied to the controllable positive return 18 in a manner to be described more fully hereinafter. Controllable positive return 18 can be controlled so as to allow current to flow therethrough during the entire positive half of each cycle or any fraction thereof or the flow of current can be prevented entirely during the positive half of each cycle. It can therefore be seen that the current which passes through the load 12 can be adjusted between 50 percent and 100 percent.

Also connected to the load 12 and the negative return 16 and controllable positive return 18 is a failure sense and override circuit 20. Circuit 20 monitors the negative return 16 and controllable positive return 18 to insure that they are conducting at the proper time. If either return 16 or 18 fails to conduct when it is supposed to, thus indicating a defective component therein, failure sense and override circuit 20 takes over and switches full power to the load 12 by completing a series circuit between source 14, load 12 and ground through the failure sense and override circuit 20. Once failure sense and override circuit 20 takes over, full power is delivered to the load 12 and the intensity of the traffic lights can no longer be controlled.

The control signals for controlling the controllable positive return 18 of circuit 10 originate with an alternating current source 22 which also preferably is a conventional 115 volt 60 cycle A.C. line. In fact, source 22 is preferably the identical source as source 14. The 60 cycle signal from source 22 is converted to a series of pulses by a pulse generator 24.

The output of pulse generator 24 is connected to a gating logic circuit 26 which in turn has its output connected to the gating input of the controllable positive return 18. Also connected to the gating logic circuit 26 is a photoconductive cell 28 which is arranged in such a manner so as to sense the ambient light intensity. Gating logic circuit 26 modifies the pulses from the pulse generator 24 and applies these pulses to the controllable positive return 18. The pulses applied to the gating input of controllable positive return 18 control the conductivity of the circuit 18 and accordingly the amount of power consumed by the load 12 during the positive half of the alternating cycle of current source 14.

Modification of the pulses by gating logic circuit 26 may be, for example, in the form of delays in the pulses. The amount of the modification, for example the amount of the time delays, of the pulses from pulse generator 24, is determined by the photoconductive cell 28. Thus, during the daylight hours the photoconductive cell 28 would instruct the gating logic 26 to cause substantially no modification of the pulses from pulse generator 24 and accordingly, these pulses would be applied directly to the gate of controllable positive return 18 without any modification. Thus, controllable positive return 18 would conduct during the entire positive cycle. On the other hand, during periods of extreme darkness, the photoconductive cell 28 would instruct the gating logic circuit 26 to cause the maximum amount of modification possible to the pulses generated by pulse generator 24 and these modified pulses, when applied to the gating input of controllable positive return 18 would prevent the positive return 18 from conducting during any part of the positive cycle and accordingly, current would flow through the load 12 only during the negative half of each cycle.

The output of pulse generator 24 is also connected to the input of a time delay circuit 30 which in turn is connected to the input of the reset circuit 32. Reset circuit 32 resets the failure sense and override circuit 20 and is used during initial start up and in the event of a power failure. In its normal condition, failure sense and override circuit 20 overrides the negative return 16 and positive return 18 allowing full current to flow through the load 12. Thus, the reset circuit 32 is needed to place the failure sense and override circuit 20 in its proper operative position so that it can properly sense any failures in the negative return 16 or positive return 18. After a blackout wherein all power is lost or when initially starting up the system, a pulse from generator 24 is delayed by a preset amount of time in time delay circuit 30 and thereafter causes reset circuit 32 to reset the failure sense and override circuit 20 so that it can function in the manner described hereinabove.

Figure 2:
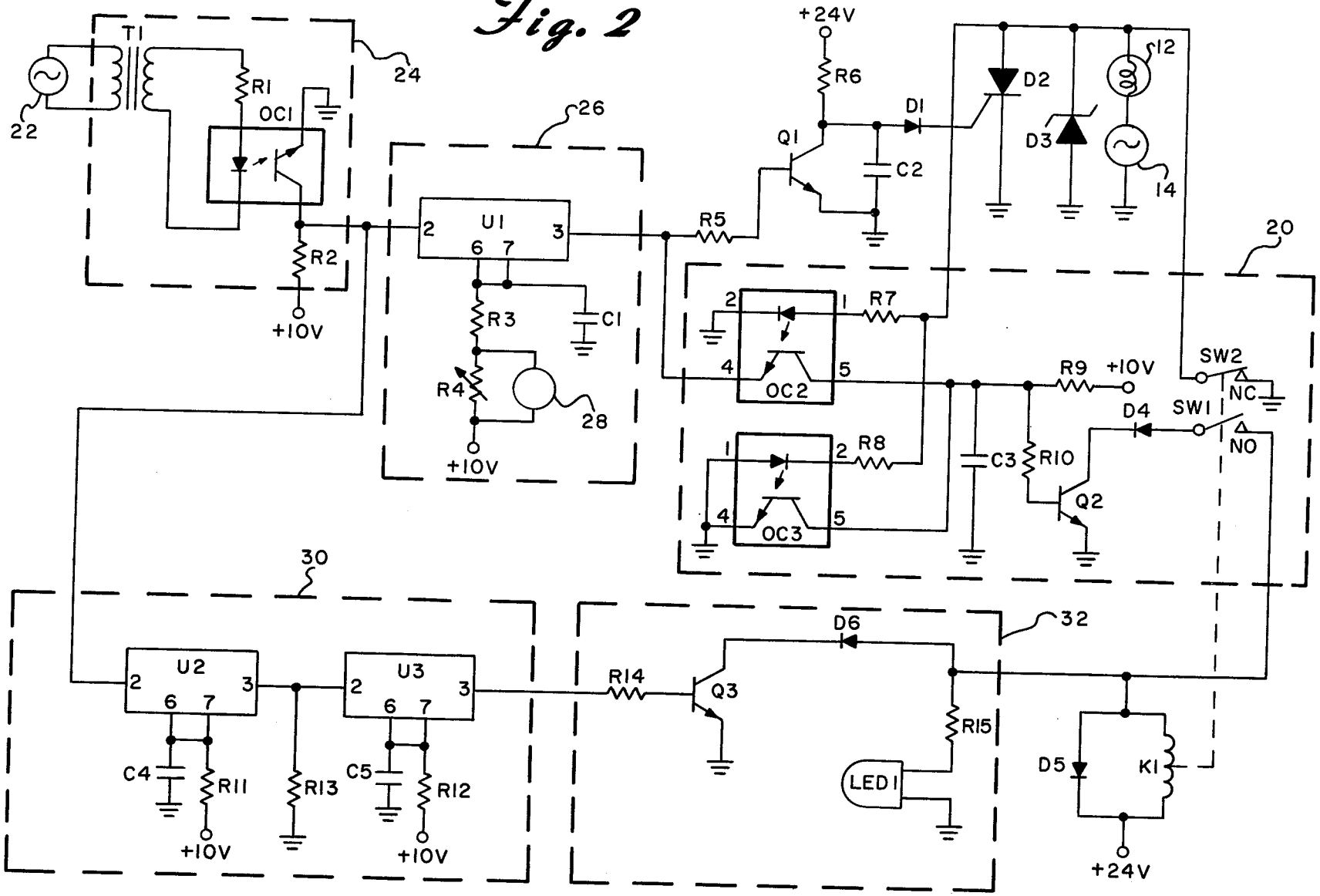
FIG. 2 is a schematic diagram of the circuit shown in FIG. 1, showing the several circuit components in more detail.

Referring now to FIG. 2, there is shown therein a schematic diagram similar to FIG. 1 but showing each of the circuits of FIG. 1 in substantially more detail. Like reference numerals have been used where appropriate to indicate similar elements in the two figures.

Referring first to the upper left side of FIG. 2, there is shown an alternating current source 22 which as stated above is preferably a conventional 115 volt 60 cycle A.C. line. The 115 voltage from source 22 is reduced by step down transformer T1. One side of the secondary of step down transformer T1 is connected to the anode of optical cupler OC1 through resistor R1. The emitter of optical cupler OC1 is connected to ground and the collector, which also serves as the output of optical cupler OC1, is connected to a positive 10 volt source through resistor R2.

The output of optical cupler OC1 which is a series of pulses in the form of a square wave is connected to the input of a time delay device U1. Time delay device U1 may be for example, a National Semiconductor timer LM55 or equivalent circuit. The amount of the time delay provided by time delay device U1 is determined by the combination of resistor R3, variable resistor R4, capacitor C1 and photoconductive cell 28. Photoconductive cell 28 may be, for example, a CdSe or Cds cell such as model CL503, CL504 or CL505 manufactured by Clairex Electronics. With capacitor C1, resistor R3 and variable resistor R4 preset, however, the amount of time delay provided by the time delay device U1 depends on the intensity of the light impinging on photoconductive cell 28. As described above, photoconductive cell 28 is situated in such a way that it senses the ambient light.

The output of time delay device U1 is normally low but goes high when the input goes low and stays high for the amount of time determined by cell 28. This output is connected to the base of transistor Q1 through resistor R5. The collector of transistor Q1 is connected to the junction of resistor R6, capacitor C2 and diode D1. The other side of resistor R6 is connected to a positive voltage source. The other side of capacitor C2 is connected to the emitter of transistor Q1 and to ground. Diode D1 is connected to the control gate of silicon controlled rectifier (SCR) D2. The anode of SCR D2 is connected to the cathode of zener diode D3 and to one side of the load 12. The other side of load 12 is connected to one side of alternating current source 14. The cathode of SCR D2, the anode of zener diode D3 and the other side of the alternating current source 14 are commonly connected. As should now be readily apparent, the zener diode D3 represents the negative return circuit 16 of FIG. 1 and the SCR D2 represents the controllable positive return circuit 18.

The failure sense and override circuit 20 referred to above in FIG. 1 is shown in the right central part of FIG. 2. This circuit is comprised essentially of optical cuplers OC2 and OC3, transistor Q2 and relay K1. The anode of optical cupler OC2 is connected through resistor R7 to the junction of SCR D2, zener diode D3 and load 12. Similarly, the cathode of optical cupler OC3 is connected through resistor R8 to the same junction. The cathode of optical cupler OC2 is connected to ground and the emitter thereof is connected to the output of time delay device U1. The anode of optical cupler OC3 and the emitter thereof are both connected to ground.

The collectors of optical cuplers OC2 and OC3 are connected together and to the junction of resistors R9, R10 and capacitor C3. Resistor R9 is connected to a positive 10 volt source, capacitor C3 to ground and resistor R10 to the base of transistor Q2. The emitter of transistor Q2 is grounded and the collector, through diode D4 is connected to one side of a normally open switch SW1. The other side of switch SW1 is connected to one side of the coil of relay K1. Normally open switch SW1 and normally closed switch SW2 are the relay contacts of the relay K1 and accordingly are controlled by the coil of relay K1. One side of normally closed switch SW2 is connected to the junction of SCR D2, zener diode D3 and the load 12. The other side of switch SW2 is connected to ground. The other side of the coil of relay K1 is connected to a positive 24 volt source and a diode D5 is connected across the coil of relay K1.

The time delay circuit 30 and reset circuit 32 in FIG. 1 are shown in the bottom left of the schematic of FIG. 2. Time delay circuit 30 is comprised essentially of two series connected time delay devices U2 and U3. The input of time delay device U2 is connected to the output of the pulse generator 24. Resistors R11 and R12 and capacitors C4 and C5 determine the timing cycle for the amount of delay of time delay devices U2 and U3. Resistor R13 is connected between the junction of the output of U2 and the input of U3 and ground.

With respect to the reset circuit 32 the output of time delay device U3 is connected through resistor R14 to the base of transistor Q3. The cathode of diode D6 is connected to the collector of transistor Q3 and the anode of diode D6 is connected to the junction of normally open switch SW1 and the coil of relay K1. Also connected to this junction is one side of resistor R15. The other side of resistor R15 is connected to one side of a light emitting diode LED1, the other side of which is grounded. In addition, the emitter of transistor Q3 is also grounded.

The circuit shown in FIG. 2 functions as follows. Upon initial start up, the output of optical cupler OC1 triggers time delay device U2 and a timing cycle begins. This timing cycle, which is determined by the user, may be, for example, ½ hour. After this time, the time delay device U3 will be triggered. The output of U3 supplies a base pulse to transistor Q4 to energize and pull in relay K1. This closes switch SW1 and opens switch SW2. With switch SW1 closed, and assuming proper operation of all other components, relay K1 will hold itself closed since a complete series circuit would be established between the 24 volt source, the coil K1, switch SW1, diode D4 and transistor Q2 to ground.

With switch SW1 closed and switch SW2 opened by relay K1, the dimmer circuit controls the current to the load 12. However, in the event of a brown out where the input voltage to the system may drop below 90 volts, for example, the holding current of the relay K1 may not be supplied and the relay will open. This will close switch SW2 thereby supplying full voltage to the lights (load 12). This full voltage is supplied since a series circuit is completed between ground, the alternating current source 14, load 12, switch SW2 and back to ground.

Assuming again that relay K1 has been energized as a result of the self-starting capabilities of the system and that the dimmer circuit is controlling the lights 12, it can be seen that during the negative half of each cycle of the alternating current source 14, current does pass through the load 12 since there is a completed circuit comprised of source 14, zener diode D3 and load 12. Similarly, current will flow through the load 12 during the positive half of each cycle when SCR D2 is conducting. SCR D2 conducts, of course, only when there is a positive voltage applied to its anode and a positive current is applied to its gate.

Since the same voltage source is used for providing the pulses from the optical cupler OC1 and for the current source 12, it should be readily apparent that the input pulses to the time delay device U1 are in phase with the voltage applied to the anode of SCR D2. However, it is the output of U1 which controls the base of transistor Q1 which in turn controls the gate to SCR D2. Thus, it should be readily apparent that by controlling the output of U1, the time during which SCR D2 is switched on during each positive half of each cycle can be delayed. The longer that the output of U1 is maintained high, the less time during each cycle that SCR D2 will conduct. As stated above, the amount of delay is directly related to the intensity of the ambient light as sensed by photoconductive cell 28.

The failure sense and override circuit 20 functions in the following manner. Optical cupler OC2 detects the differential in the positive voltage across the silicon control rectifier D2 and the optical cupler OC3 detects the negative voltage differential across the zener diode D3. If a differential in voltage is detected during the noncontrolled portion of the positive cycle (i.e. when the output of U1 is low), conduction will occur through R7 turning on optical cupler OC2. Optical cupler OC2 will only be turned on during the noncontrolled portion of the positive cycle since the emitter of optical cupler OC2 is connected to the output of time delay device U1. As a result, the emitter of optical cupler OC2 is high during that portion of the positive cycle when silicon control rectifier D2 is not conducting. Similarly, detection during the negative half of each cycle for diode failure is accomplished by detecting a differential in the voltage across zener diode D3 which will supply current through resistor R8 turning on optical cupler OC3.

If either optical cupler OC2 or OC3 conducts, the base voltage of transistor Q3 will go to zero and the collector will turn off therefore removing the ground return from relay K1. As a result, relay K1 will deenergize. This will cause switch SW1 to return to its normally open position and switch SW2 to return to its normally closed position. With switch SW2 in its normally closed position, full power is delivered to the load 12 from source 14. It should be noted that the values of resistor R10 and capacitor C3 are chosen so that there is a time delay of preferably three cycles before the base voltage is removed from transistor Q2. This insures that the transistor Q2 will not be cut off unless there is in fact a defect sensed in SCR D2 or zener diode D3.

Upon sensing a defect in either SCR D2 or zener diode D3, in addition to bypassing the diodes, a circuit is completed through relay coil K1, resistor R15 and light emitting diode LED1. The current passing therethrough is not sufficient to pull in the relay K1 but is sufficient to light the diode LED1 which would be mounted so as to be visible from the outside of the housing for the light dimming system. This would communicate to a technician or repairman that one of the two diodes has become defective and should be replaced. In the meantime, however, full power will be delivered to the lights 12. After the defective component is replaced, the light dimmer system will reset itself in the manner described above.

The values of the various component parts utilized in the circuit of the preferred embodiment of FIG. 2 are listed in the TABLE below. It should be understood, however, that these values are by way of example only and that various other components and values thereof could be substituted therefor.

TABLE

| | | |
|---|---|---|
| R1=6.8K | R6=500 | R11=12K |
| R2=47K | R7=12K | R12=100K |
| R3=47K | R8=12K | R13=12K |
| R4=200K | R9=12K | R14=4.7K |
| R5=4.7K | R10=5.6K | R15=20K |
| C1=.1ufd | C3=22ufd | C5=1.0ufd |
| C2=.01ufd | C4=390ufd | |

TABLE-continued

| | | |
|---|---|---|
| D1=1N4003 | D3=1N1186 | D5=1N4003 |
| D2=2N3897 | D4=1N4003 | D6=1N4003 |
| Q1=TIP29A | Q2=TIP29A | Q3=TIP29A |
| OC1=TIL111 | OC2=TIL111 | OC3=TIL111 |

The present invention may be embodied in other specific forms without departing from the spirit or essential attributes thereof and, accordingly, reference should be made to the appended claims, rather than to the foregoing specification as indicating the scope of the invention.

We claim:

1. In a dimmer circuit including a unilateral conducting means adapted to be placed in series with a light means for decreasing the power provided by an A.C. source of voltage to said light means, the improvement comprising:

means for sensing the forward voltage across said unilateral conducting means, and means responsive to said sensing means for overriding said unilateral conducting means for providing full power to said light means upon failure of said unilateral conducting means.

2. In a dimmer circuit as claimed in claim 1 wherein said unilateral conducting means is controllable whereby it can be made to selectively conduct and nonconduct in accordance with command signals.

3. In a dimmer circuit as claimed in claim 2 further including means responsive to the intensity of the ambient light for generating said command signals for controlling said unilateral conducting means.

4. In a dimmer circuit as claimed in claim 3 wherein said unilateral conducting means is a silicon controlled rectifier.

5. In a dimmer circuit as claimed in claim 3 further including another unilateral conducting means; said another unilateral conducting means being in parallel with said first mentioned unilateral conducting means and being adapted to conduct in the opposite direction of said first unilateral conducting means.

6. In a dimmer circuit as claimed in claim 5 wherein said sensing means are adapted to sense the voltage across both of said unilateral conducting means.

7. In a dimmer circuit including a unilateral conducting means adapted to be placed in series with a light means for decreasing the power provided by an A.C. source of voltage to said light means, the improvement comprising:

means for monitoring the operation of said unilateral conducting means, and means responsive to said monitoring means for overriding said unilateral conducting means for providing full power to said light means upon failure of said unilateral conducting means.

8. In a dimmer circuit as claimed in claim 7 wherein said unilateral conducting means is controllable whereby it can be made to selectively conduct and nonconduct in accordance with command signals.

9. In a dimmer circuit as claimed in claim 8 further including means responsive to the intensity of the ambient light for generating said command signals for controlling said unilateral conducting means.

10. In a dimmer circuit as claimed in claim 8 further including another unilateral conducting means; said another unilateral conducting means being in parallel with said first mentioned unilateral conducting means and being adapted to conduct in the opposite direction of said first unilateral conducting means.

* * * * *